United States Patent [19]

Pohlig

[11] 4,128,218

[45] Dec. 5, 1978

[54] METHOD OF DIRECTION FINDING AND DIRECTION INDICATION OF RAILBOUND VEHICLES

[75] Inventor: Winfried Pohlig, Stuhr, Fed. Rep. of Germany

[73] Assignee: U.S. Philips Corporation, New York, N.Y.

[21] Appl. No.: 830,630

[22] Filed: Sep. 6, 1977

[30] Foreign Application Priority Data

Sep. 11, 1976 [DE] Fed. Rep. of Germany ..... 2640971

[51] Int. Cl.[2] ..... B61L 13/04

[52] U.S. Cl. ..... 246/247; 246/77

[58] Field of Search ..... 246/34 R, 77, 247, 249, 246/250, 255; 324/34 D, 34 PS, 165, 178, 179; 340/23, 31 R, 38 R, 38 L, 146.3 Y

[56] References Cited

U.S. PATENT DOCUMENTS

| | | | |
|---|---|---|---|
| 3,144,225 | 8/1964 | Suerkemper et al. | 246/247 X |
| 3,281,593 | 10/1966 | Mendelsohn | 246/249 |
| 3,581,084 | 5/1971 | Kaneno et al. | 246/249 |
| 3,721,821 | 3/1973 | Blanyer | 246/249 |
| 3,941,338 | 3/1976 | Knudsen | 246/77 |
| 3,965,751 | 6/1976 | Harvalik | 340/38 L X |
| 3,967,262 | 6/1976 | Reich et al. | 340/38 R X |

FOREIGN PATENT DOCUMENTS

| | | | |
|---|---|---|---|
| 1042000 | 10/1958 | Fed. Rep. of Germany | 246/77 |

*Primary Examiner*—Stephen G. Kunin
*Attorney, Agent, or Firm*—Bernard Franzblau

[57] ABSTRACT

Method for direction finding and indication of railbound vehicles by means of a pair of axle counters arranged on the railway track and operating with seismic and magnetic sensors and which supply electric signals from whose time sequence the direction indication value is derived, the direction indication values released by several axles of the vehicle being summed and the direction indication being derived therefrom.

8 Claims, 4 Drawing Figures

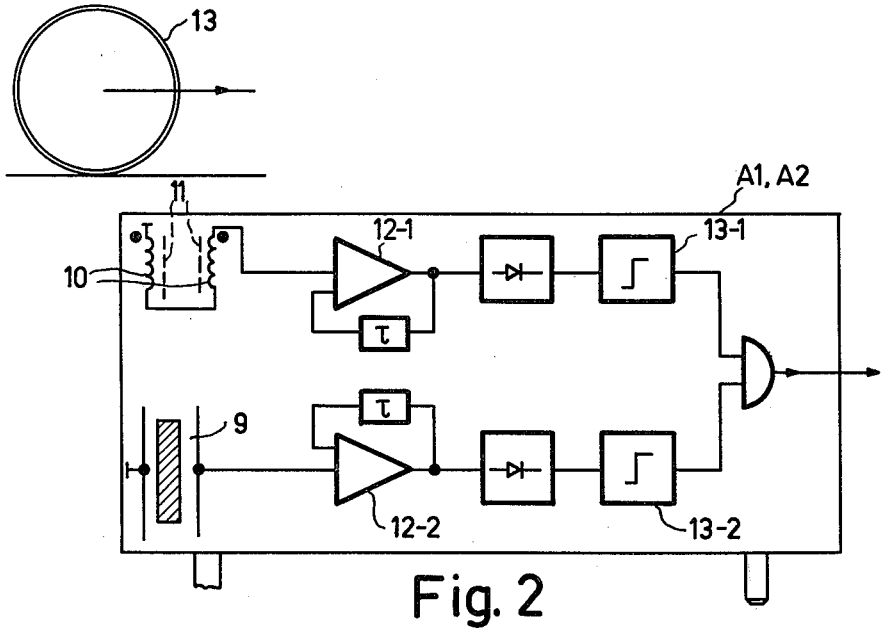
Fig. 2
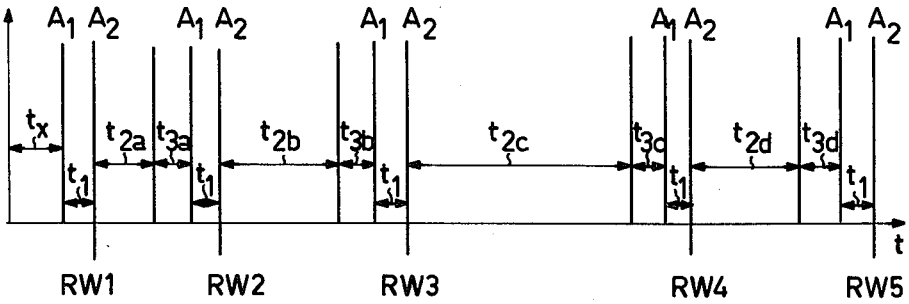
Fig. 3
| $S_1$ | $S_2$ | $S_3$ | $S_4$ |
|---|---|---|---|
| RW1 | | x | $t_{2a}$ |
| RW2 | | x | $t_{2b}$ |
| RW3 | x | | $t_{2c}$ |
| RW4 | | x | $t_{2d}$ |
| RW5 | | x | |
| (E) | | x ! | |
Fig. 4

METHOD OF DIRECTION FINDING AND DIRECTION INDICATION OF RAILBOUND VEHICLES

The invention relates to a method of direction finding and direction indication of railbound vehicles by means of a pair of axle counters arranged on the track and which operate with seismic and magnetic sensors and supply electric signals from whose instantaneous sequence the direction indication value is derived.

If the interpretation of the travel direction supplied by the axle counters is considered in conjunction with obstacle warning systems, we may say that all obstacle warning systems suppress the warning signal to the train when the train travels away from the obstacle. As in these systems human lives are involved the signal-technical security as regards the correct indication of the direction of the train must be particularly great.

It must therefore be absolutely impossible that disturbances indicate an incorrect direction of train travel. To this end three axle counters have been arranged one behind the other on the railway track. The correct excitation of these axle counters has indeed improved the signal-technical safety, the cost and trouble of the rail has however increased. False reports may, for example, be produced when, in the seismic excitation phase, the magnetic sensor part is energized when no wheel passes it. As an absolute uniformity in the sensitivity of the magnetic sensors of the two axle counters can be considered to be out of the question it is possible that, in the case of a magnetic disturbance, the "wrong" sensor is energized before the "correct" sensor.

This magnetic disturbance originates from the rail currents which may amount to some hundreds of amperes. In their turn they produce in the axle counter spacing fields up to 80 A/m, which is, however, already in the range of the useful fields caused by the motor currents flowing through the wheels. By means of a differential operation of the magnetic pick-up device these disturbances can be suppressed by approximately 40 dB. In this way false reports caused by non-energization of an axle counter are excluded as it is not difficult to make the sensors sensitive enough.

It is an object of the invention to provide a safe direction finding method when only one pair of axle counters is used.

This object is accomplished in that the direction indication values released by several axles of the vehicles are added together from which the direction indication is derived.

When a train travels over the pair of axle counters, the correct direction is mainly indicated by making several evaluations of the direction during passage of the train. This is based on the spacing between the axle counters relative to the large axle spacings of the train (for example several meters). If during passage of the train a direction value is interrogated, it will hardly happen that during the instantaneous measuring procedure a wheel is located just between the two axle counters. The probability that the correct sensor of the axle counter is energized first is, for example, for an axle spacing of 20 m and an axle counter spacing of 60 cm a factor of $(20 - 0.6/0.6) = 32$.

This factor is considerably increased when several, for example five, measurements are taken, wherein the first measurement has already a very high probability of correctness as, compared to the further measurements, it does not have the uncertainty of the wheel which has already passed the axle counters.

An embodiment of the method and means for its performance will be described in greater detail with reference to the accompanying drawing in which:

FIG. 2 shows diagrammatically a set-up of an axle counter,

FIG. 3 is a time diagram, and

Figure 1:
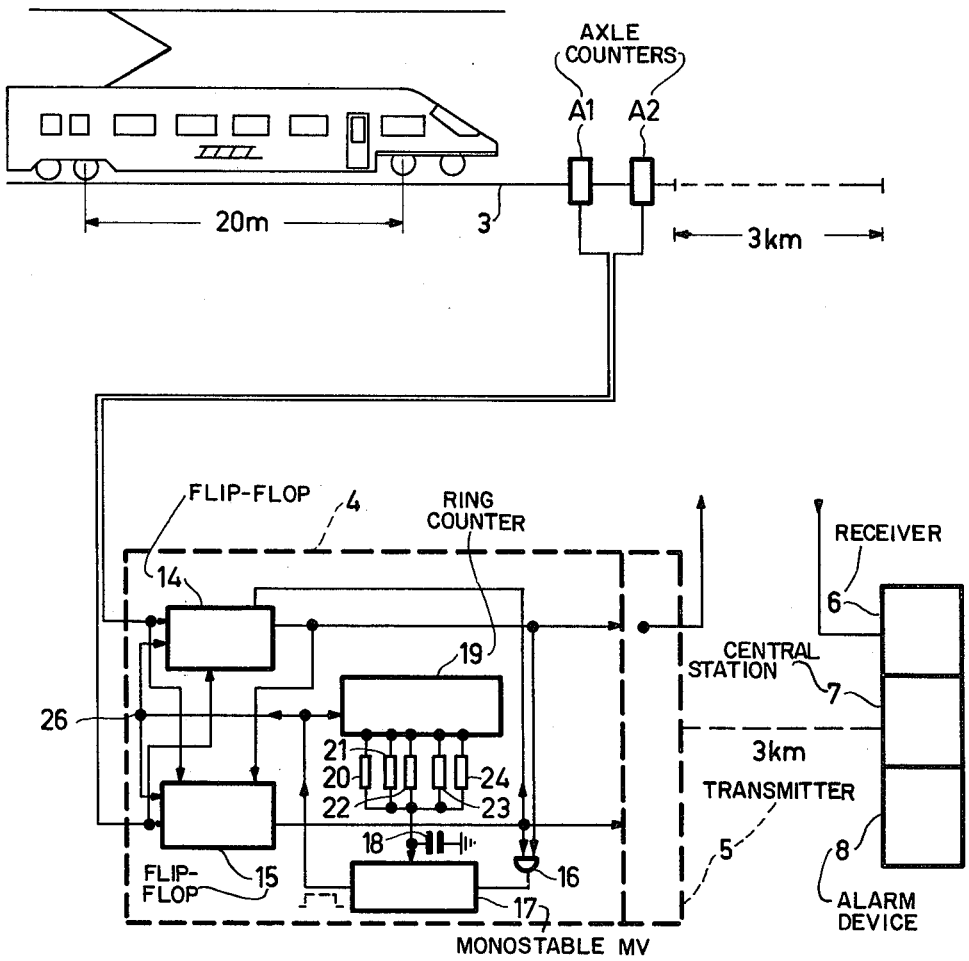
FIG. 1 shows diagrammatically the set-up of a warning system.

FIG. 4 a direction evaluation table.

As shown in FIG. 1 two axle counters $A_1$ and $A_2$ are disposed on the railway track 3 with a spacing s (single threshold distance). These two axle counters are connected to an exterior station 4 whose electronic components are successively energized by $A_1$ and $A_2$. It is consequently able to transmit the train direction via a radio transmitter 5. After receipt in the radio receiver 6 of the signals from the device located near the obstacle, the direction indication values are added in its central station 7 and an alarm device 8 is subsequently put into operation. The axle counters $A_1$ and $A_2$ operate seismically and magnetically and may each consist, as shown in FIG. 2, of a piezo disk 9 and a dual coil 10, which operates differentially and which is wound on a ferrite core to which amplifiers 12–1, 12–2 and Schmitt trigger stages 13–1, 13–2 are connected. The seismic sensor 9 primes the axle counters $A_1$, $A_2$. It is energized approximately 30 m before the train arrives. The magnetic sensor 10 is triggered when it is passed by the wheel 13 so that at the axle counters $A_1$, $A_2$ an output signal is produced which is applied to the electronic stage of the exterior station 4. Depending on the direction of travel of the train the axle counter $A_1$ is energized before the axle counter $A_2$ or vice versa.

If, for example, $A_1$ is energized first flip-flop 14 is made operative. If thereafter $A_2$ is energized flip-flop 15 is through-connected and 14 is cut off.

As a consequence the train direction is supplied to the radio transmitter. Simultaneously, a monostable multivibrator 17 is triggered through the OR-gate 16. The time constant of the monostable multivibrator 17, that is to say the multivibrator, is composed of the capacitor 18 and one of the five different output resistors of a ring counter 19 (i.e. resistors to be 24 inclusive). The time during which the monostable multivibrator 17 is in the triggered state varies with and depends on which position of the ring counter 7 is switched on.

The flip-flops 14 and 15 remain cut off through the reset inputs 26 for a same period of time, that is to say a waiting period of varying length is obtained after each direction value until the logic can again be energized.

If the monostable multivibrator 17 is switched off, the ring counter 19 moves one position further so that a new waiting period is prepared.

FIG. 3 shows the time sequence of, for example, five direction values ($RW_1$, $RW_2$, . . . $RW_5$). After a random time $t_x$ the axle counter $A_1$ is energized for the first time.

If the train travels, for example, at the maximum speed of 160 km/h the axle counter $A_2$ is energized after a time $t_1$ of approximately 10 ms and the first direction value ($RW_1$) is available. To avoid any irregularities in connection with the speed of the train each of the direction values are followed by respective locking and waiting times $t_{2a}$–$t_{2d}$ of varying length. The axle counters cannot be energized before these periods of time have elapsed. If, after termination of the waiting period $t_{2a}$, a train still passes the axle counters, a further period of time $t_{3a}$ can elapse before the first axle counter is again energized by a wheel. In the most unfavourable case at a speed of 6 km/h and an axle spacing of 20 m this may be 12 seconds minus $t_{2a}$. Thereafter the second direction value is obtained when the axle counters $A_1$ and $A_2$ are energized etc. Starting from a measuring sequence shown in FIG. 3 the table shown in FIG. 4 are, for example, obtained for the logic of the direction evaluation. This table shows in the first column $S_1$ the direction values ($RW_1$, . . . $RW_5$), in the second column $S_2$ the indication that the direction of the train is away from the obstacle, in the third column $S_3$ the indication that the train travels towards the obstacle and in the fourth column $S_4$ the waiting period $t_2$. For a further explanation of the system a false report is included for the direction value $RW_3$. So in this situation the wheel was between the axle counters when the measurement started or a magnetic interference occurred owing to extremely high rail currents etc. Important here is the result (E) which ascertains that the most prevailing direction is the correct one. It is advisable for the waiting periods $t_{2a}$–$t_{2d}$ not to go below a minimum period of 0.4 sec. If, namely, for example owing to an interference, the second axle counter $A_2$ is made operative a false direction value is obtained for the first axle counter $A_1$ when the wheel passes it. If the train travels only 6 km/h the wheel which has just triggered the first axle counter $A_1$ requires 0.36 seconds until it has covered the 60 cm to reach the second axle counter $A_2$. For this period of time the axle counters must, however, be blocked for at least a time $t_2$ as otherwise also the second direction value ($RW_2$) would be incorrect. If 0.4 seconds is assumed in principle for $t_{2a}$ then two direction values (axle spacing $<10$ m) would still be obtained for a single locomotive up to a speed of 90 km/h. In case this would result in an incorrect direction value against a correct direction value this should in any case result in an interference indication.

The customary distance from the exterior station of an obstacle warning system to the obstacle is approximately 3 km. This leaves the obstacle, in the case of a warning signal, a period of time of approximately 66 seconds to clear the railway track for a train which travels at 160 km/h. With a measuring sequence of, for example, five direction values there would not yet be dangerous approaching times of the train to the obstacle as, for example, for a fast train the times $t_1$ and $t_{3a}$–$t_{3d}$ can be neglected and the times for $t_2$ can be made very short. But a longer measuring series would of course considerably increase the reliability of the system.

Slow trains may result in considerable periods of time for $t_{3a}$–$t_{3d}$ and, in the extreme case, even 12 seconds for a time period of $t_2$ $t_3$. These are, however, non-critical as the train now also requires a considerably longer time to arrive at the obstacle.

What is claimed is:

1. A method of determining and indicating the direction of travel of a rail-bound vehicle by means of a pair of axle counters each of which includes a seismic and a magnetic sensor which operate together to supply electric signals having a time sequence which indicates the direction of vehicle travel, said method comprising arranging said pair of axle counters along the railway track and spaced from each other in a direction parallel to the track rail, a seismic sensor being made operative to actuate its axle counter only when a railway vehicle is in its vicinity, making a first time sequence reading by means of said pair of axle counters and with the seismic sensors operative, inhibiting the making of a second time sequence reading for a first time period subsequent to the making of the first time sequence reading, making a second similar time-sequence reading for another vehicle axle after the first time period is terminated, inhibiting the making of a third time sequence reading for a second time period different from the first time period and subsequent to the making of the second time sequence reading, and summing the first and second time sequence readings to derive a direction of vehicle travel indication therefrome 2. A method as claimed in claim 1 comprising the further step of making a third time sequence reading for another vehicle axle after termination of the second time period and before the summing operation, and wherein the summing operation sums the first, second and third time sequence readings to derive said indication of the direction of vehicle travel along the rail.

3. A railway detection system for determining the direction of travel of a rail-bound vehicle comprising, a pair of axle counters arranged along the railway track and spaced apart in the longitudinal direction of the rail, each axle counter including a seismic sensor and a magnetic sensor which operate together to supply electric signals in response to a passing vehicle which signals have a time sequence that indicates the direction of train travel, each axle counter including means controlled by the seismic sensor for activating the axle counter to supply its electric signal only when a railway vehicle is in its vicinity, and a detection circuit including first and second bistable devices respectively coupled to the outputs of said pair of axle counters and responsive thereto to produce a control signal indicative of vehicle direction of travel, the detection circuit further comprising, means responsively coupled to an output of at least one of said bistable devices for deriving an inhibit signal that blocks the operation of the bistable devices for a time period subsequent to the production of a control signal, means coupled to said inhibit signal deriving means for varying the inhibit time periods developed between various control signals, and means for summing a plurality of control signals to derive an output signal indicative of the direction of vehicle travel along the rail.

4. A detection system as claimed in claim 3 wherein said inhibit signal deriving means includes a monostable multivibrator having an input coupled to the outputs of the bistable devices and an output coupled to the reset inputs of the bistable devices, the trigger time of the monostable multivibrator being varied by said inhibit time period varying means for successive control signals produced.

5. A detection system as claimed in claim 4 wherein said inhibit time period varying means comprises a ring counter which is stepped in synchronism with output pulses produced by the monostable multivibrator and has a plurality of time constant elements selectively coupled to the monostable multivibrator to control and adjust its trigger time as a function of the position of the ring counter.

6. A detection system as claimed in claim 3 wherein said inhibit signal deriving means includes a monostable multivibrator triggered by the outputs of the bistable devices via an OR gate, and said inhibit time period varying means comprises a ring counter which adjusts the trigger time of the monostable multivibrator, the output of the monostable multivibrator being connected to the input of the ring counter and to reset inputs of the bistable devices.

7. A detection system as claimed in claim 3 wherein the seismic sensor of the axle counter includes a piezoelectric element that is normally activated by a vehicle prior to activation of the magnetic sensor by said vehicle and the magnetic sensor includes a pair of dual coils coupled to operate differentially, and each axle counter further comprises gate means coupled to the outputs of the seismic and magnetic sensors for deriving said electric signals.

8. A detection system as claimed in claim 3 wherein said inhibit signal deriving means includes means for generating pulses in response to the bistable devices, and said inhibit time period varying means includes electronic switching means switched in synchronism with said generated pulses and having adjustable time-constant circuit means that varies with the switching operation and coupled to the pulse generating means to control the width of the pulses generated thereby.

* * * * *

UNITED STATES PATENT OFFICE

CERTIFICATE OF CORRECTION

Patent No. 4,128,218 Dated Dec. 5,1978

Inventor(s) Winfried Pohlig

It is certified that error appears in the above-identified patent and that said Letters Patent are hereby corrected as shown below:

Col. 1, line 37, Delete "spacing"

line 67, Cancel "has already" and insert -- already has --

Col. 2, line 42, Delete " , that is "

line 43, Delete "to say the multivibrator,"

line 48, After "counter" change "7" to -- 19 -- line 50, After "for" change "a" to --the--

Col. 3, line 3, After "this" insert -- period -- line 7, After " Fig. 4 " change "are" to -- is --

Col. 2, line 45, change "( i.e. resistors to be 24 inclusive)" to read -- ( i.e. resistors 20 to 24 inclusive) --.

UNITED STATES PATENT OFFICE
CERTIFICATE OF CORRECTION

Patent No. 4,128,218 Dated Dec. 5,1978

Inventor(s) Winfried Pohlig

It is certified that error appears in the above-identified patent and that said Letters Patent are hereby corrected as shown below:

Col. 3, line 21, After "advisable" change "for" to -- that -- line 22, After "not" delete "to"

line 31, After "otherwise" delete "also"

line 32, Before "would" insert -- also -- line 53, Change " $t_2$ $t_3$ " to read -- $t_2 + t_3$ -- line 54, After "now" delete "also"

Signed and Sealed this

Thirty-first Day of March 1981

[SEAL]

Attest:

RENE D. TEGTMEYER

Attesting Officer

Acting Commissioner of Patents and Trademarks